US006846056B2

(12) United States Patent
Jacobsen et al.

(10) Patent No.: US 6,846,056 B2
(45) Date of Patent: Jan. 25, 2005

(54) OPTIMIZING PRINTING PARAMETERS FOR A PRINT MEDIUM

(75) Inventors: Dana A. Jacobsen, Boise, ID (US); Terry-Lee M. Fritz, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 13 days.

(21) Appl. No.: 10/322,434

(22) Filed: Dec. 17, 2002

(65) Prior Publication Data

US 2004/0114023 A1 Jun. 17, 2004

(51) Int. Cl.[7] ..... B41J 29/38
(52) U.S. Cl. ..... 347/14; 283/17; 399/45
(58) Field of Search ..... 347/14, 17, 19, 347/107, 193; 399/45, 389; 400/708; 283/17, 72–74, 81, 86, 91–93, 113, 901; 235/489, 494

(56) References Cited

U.S. PATENT DOCUMENTS 4,373,801 A * 2/1983 Itoh ..... 399/45
4,739,377 A * 4/1988 Allen ..... 355/133
5,459,580 A * 10/1995 Suzuki ..... 358/296
5,757,393 A * 5/1998 Suzuki ..... 347/16
6,019,461 A * 2/2000 Yoshimura et al. ..... 347/86
6,175,714 B1 * 1/2001 Crean ..... 399/366
6,198,451 B1 * 3/2001 Aylward et al. ..... 343/756
6,203,220 B1 3/2001 Takenoshita et al.
6,253,041 B1 * 6/2001 Tomizawa et al. ..... 399/66
6,255,665 B1 7/2001 Elgee et al.
6,387,846 B1 5/2002 Shinozaki et al.
6,450,634 B2 9/2002 Elgee et al.
6,527,356 B1 * 3/2003 Spurr et al. ..... 347/16
6,546,210 B1 * 4/2003 Nakamura ..... 399/12
2002/0015066 A1 * 2/2002 Siwinski et al. ..... 347/19

FOREIGN PATENT DOCUMENTS

| | | |
|---|---|---|
| EP | 0875482 | 11/1998 |
| EP | 0884195 | 12/1998 |
| EP | 0937581 | 1/2001 |
| FR | 2670927 | 6/1992 |
| JP | 63-216769 | 9/1988 |
| JP | 2-116577 | 5/1990 |
| JP | 2001-22246 | 1/2001 |

OTHER PUBLICATIONS

Mar. 25, 2004 Search Report for GB Application 0327528.6.

* cited by examiner

*Primary Examiner*—Lamson Nguyen
*Assistant Examiner*—Blaise Mouttet

(57) ABSTRACT

A print medium preferably includes an identification device on or in the print medium. The identification device provides encoded printing parameters for optimizing or controlling printing by a printer on the print medium.

20 Claims, 6 Drawing Sheets

OPTIMIZING PRINTING PARAMETERS FOR A PRINT MEDIUM

BACKGROUND

With computer applications, such as word processing, spreadsheet and computer-aided design programs, computers in homes and offices can be used to produce an infinite variety of documents. Frequently, it is desired to have those document rendered in hardcopy form for storage or transmission. Consequently, printers have been developed that allow users to print, in gray scale or full color, the documents produced or stored on a computer.

There are a wide variety of printers and printing devices. For purposes of this specification, the terms "printer" and "printing device" will be defined to include any device that produces a hardcopy document on a print medium from electronic data, including, but not limited to, laser printers, inkjet printers, facsimile machines, photocopiers, digital copiers, etc.

In addition to the wide variety of printing devices, there is also a wide variety of print mediums. A printing device may print on, for example, paper, cardstock, construction paper, envelopes, adhesive labels, transparencies, canvas, vinyl, glossy coated paper, fine art watercolor paper, and other print mediums. As used herein, the term "print medium" will be defined as any medium that can be used by a printing device when producing a hardcopy.

Each print medium may have different characteristics that allow it to work well, or cause it to work poorly, with a particular printing device. For example, some print mediums may be too thick for the feeding mechanism of a particular printing device. Some print mediums may be damaged by the heat or other conditions used by the printing device to render an image on the print medium. Sometimes local ambient conditions, such as humidity, can affect certain types of print mediums and how those print mediums respond to the particular printing device.

Unfortunately, printers and printing devices do not have any means of determining what print medium is supplied and what, if any, parameter adjustments could or should be made to best accommodate that print medium.

In some printers, different sizes of print media can be placed in different supply trays. The printer may then be programmed by a user as to which size of print medium will be found in which tray. The printer can then select a print medium size specified as part of a print job by drawing a sheet of print medium from the designated tray. However, if the wrong size or type of print medium has been placed in that tray, the conventional printing device will have no way of knowing that the print medium is not that specified.

SUMMARY

In one of many possible embodiments, the present invention provides a print medium that preferably includes an identification device on or in the print medium. The identification device provides encoded printing parameters for optimizing or controlling printing by a printer on the print medium.

Another embodiment of the present invention provides a printer for producing a hardcopy, including a processor for controlling actual printing parameters and a reader, in communication with the processor, for reading an identification device on a print medium that specifies printing parameters for the print medium. The processor controls the actual printing parameters in accordance with printing parameters read from the identification device.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION OF EMBODIMENTS OF THE INVENTION

An identification device is attached to, or embedded in, a print medium. A printer is then provided with a reader capable of detecting and reading the identification device. Consequently, the identification device can identify the print medium and may provide print parameters that can be utilized by the printer to best accommodate that particular print medium.

Figure 1C:
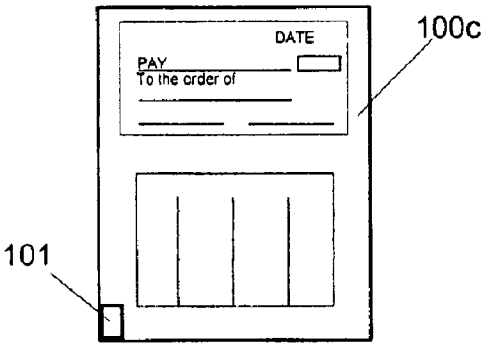
FIGS. 1*a*–1*c* illustrate a variety of print mediums according to embodiments of the present invention.
Figure 1A:
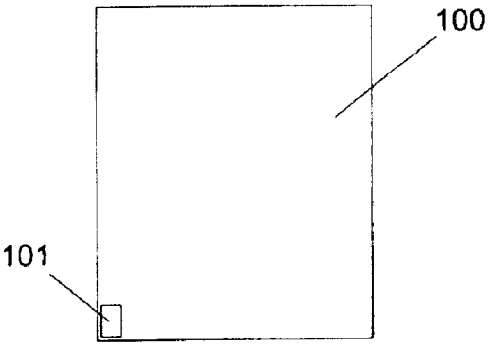

FIG. 1*a* illustrates a sheet of print medium (100) that includes an identification device (101). The identification device (101) bears data, preferably, encoded data, that identifies the print medium and/or provides one or more print parameters that a printer should use to best accommodate that print medium. Preferably, the identification device (101) is placed in or on the print medium at a location which is not usually used for printing, e.g., outside an expected print area. This can include not only areas on the printable side of the medium, but may include the sides, the back or the interior of the print medium, or multiply distributed areas on the print medium.

The identification device (101) can be a variety of devices. Any device that can be attached to, or embedded in, the print medium (100), which will not interfere with the use of the print medium by the printer and which can be used to advise the printer of information about the print medium (100) can be used as an identification device (101). For example, the identification device (101) can be an integrated circuit, a two-dimensional bar code, stochastically distributed micro dots, texture patterns, magnetic charge, ripple patterns, side cuts, removable stickers, etc.

In most instances, the identification device (101) will advise a printer or printing device of information regarding the print medium so that the printer or printing device can make adjustments that will better accommodate use of the print medium. For example, the identification device (101) can advise the printer or printing device of the thickness of each sheet or piece of the print medium. If that thickness is beyond what the feeding system of the printer can handle, the printer will not attempt to feed the print medium and thereby avoid a printer jam that may damage the printer and the print medium, while requiring the user's time to clear the jam. Variations of a single print medium type can also be indicated which could not be otherwise detected, such as different paper colors or multiple letterhead types. The printer may use this information to properly select the input device with the desired paper, or pause to request that the proper type be inserted if it is not found.

Additionally, the identification device (101) may provide the printer with statistics that define how well the print medium accepts ink. For example, the identification device (101) may quantify for the printer how porous the print medium is, how widely ink spreads when deposited on the print medium, how quickly ink dries on the print medium under specific conditions, etc. Consequently, the printer may adjust printing parameters, such as the amounts of ink deposited, drying time, operating temperature, etc., in order to provide the best print result on that print medium. These considerations may be particularly applicable to an inkjet printer.

Additionally, the identification device (101) may provide the printer with an indication of electrical and magnetic properties of the print medium. Such characteristics can be used, for example, by a laser printer to improve the print quality on the print medium. For example, based on a knowledge of the electrical and magnetic properties of the print medium, the laser printer may adjust the amount of charge placed on the print medium to facilitate the transfer of a toner image.

Moreover, laser printers and similar printing devices use heat to fuse toner to the print medium. If the print medium has a melting temperature that might be reached during the printing process, this information can be conveyed by the identification device (101) to the printer so that the heating elements can be regulated accordingly and avoid the potentially disastrous result of melting a print medium on the components of the printing device. The duration for which heat is applied may also be regulated according to data from the identification device (101) to improve the printed result and avoid damage to the printer or print medium.

Figure 1B:
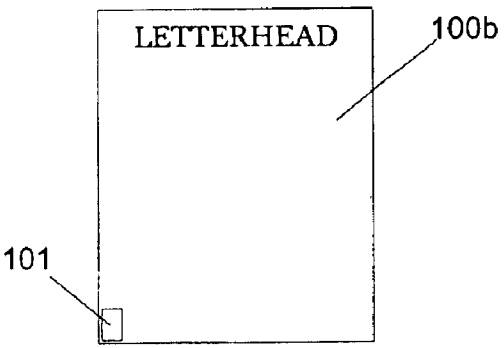

In some embodiments, the identification device (101) may secure use of the print medium by informing the printer to require a specific identification from a user before printing on that print medium (100). For example, FIG. 1*b* illustrates a sheet of print medium according to an embodiment of the present invention in which the print medium (100*b*) is a sheet of letterhead.

Because of the legal ramifications of documents printed on an organization's letterhead, it may be desirable to restrict the use of letterhead to those specifically authorized. Consequently, the identification device (101) can, among other functions, be encoded to indicate to a printing device that the print medium (100*b*) is a secured print medium, e.g., a sheet of letterhead.

The printing device is then programmed to request that the user input some form of identification before the printing device will print on the letterhead. For example, the user may be required to input a Personal Identification Number (PIN), a password, a fingerprint or other identifier. The printer will compare the input identifier with those of people authorized to use letterhead and will only print the desired document on the letterhead (100*b*) if the input identifier matches an authorized user.

A similar embodiment of the present invention is illustrated in FIG. 1*c*. In FIG. 1*c*, the print medium (100*c*) is a pre-printed check or other commercial paper that can be completed to transfer funds. Again, it may be highly desirable to restrict use of the check sheet (100*c*) to those authorized to disburse funds. Consequently, the identification device (101) that is embedded in, or attached to, the print medium (100*c*) can identify the print medium (100*c*) as a check sheet.

The printer will then require the user to enter an identifier when the printer detects the presence of a secured print medium, e.g., the check sheet (100*c*). If the identification received from the user does not match an authorized user, the printer will not print on the check sheet (100*c*). The printer may also sound an alarm or electronically alert a system manager or other responsible party that an unauthorized attempt to use a secured print medium has occurred.

Additional security can be provided by distributing the identification device (101) over larger portions of the medium or including multiple identification devices (101). The appropriate level of security for a given print medium will be determined by its users and manufacturers.

As noted above, one device that can be used as the identification device is an integrated circuit (IC). Recent advances in integrated circuits have produced IC's that are small and robust enough to embed in a print medium, such as paper. For example, some IC's now measure 3 to 60 microns in thickness and 0.4 mm square. Further improvements in IC's making them even more suitable for use in embodiments of the present invention may also be expected in coming years.

Figure 2:
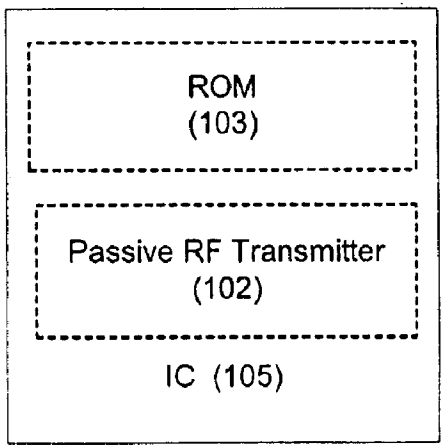
FIG. 2 illustrates an integrated circuit that can be used in some embodiments of the present invention.

Some of these IC's communicate using radio frequency transmissions and are sometimes known as radio-frequency identification tags (abbreviated "RFID"). FIG. 2 illustrates such an integrated circuit. Other such IC's communicate using other electromagnetic or other means.

As shown in FIG. 2, an IC (105) used as an identification device for print media preferably includes an amount of Read Only Memory (103). This memory (103) is used to store information about the print medium being identified that can be profitably transmitted to a printing device that is trying to accommodate the print medium or secure the print medium against unauthorized use.

A passive radio frequency (RF) transmitter (102) is also preferably included in the integrated circuit (105). The passive transmitter (102) does not require a power source and does not actively transmit data. However, when excited by energy from a scanner or reader, the passive transmitter (102) will respond by transmitting the data stored in the memory (103). In this way, a printer with an appropriate reader can read the information from the memory (103) about the print medium to which the integrated circuit (105) is attached by driving the passive transmitter (102). It should be noted that RFID tags that actually use radio-frequency communications are well suited for these applications. However, other types of IC's with other means of communication can also be profitably used.

Figure 3:
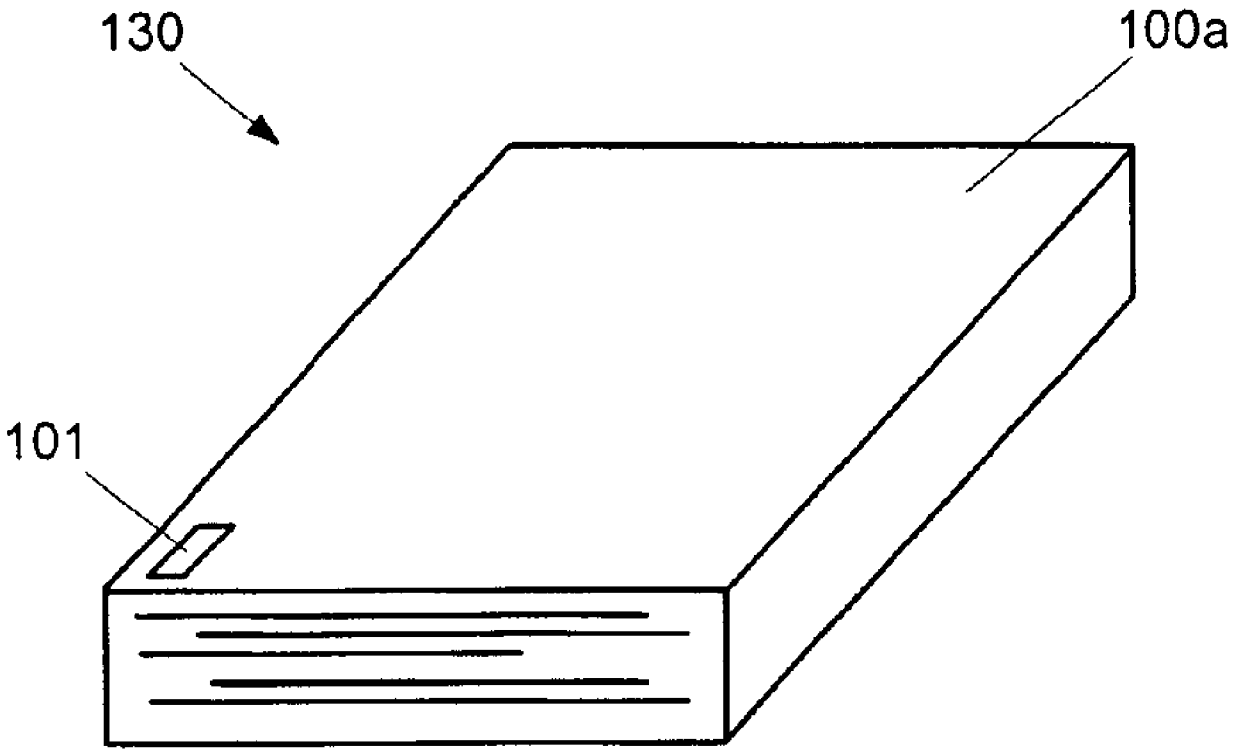
FIG. 3 illustrates a stack or supply of a print medium according to an embodiment of the present invention.

FIG. 3 illustrates a stack or supply of a print medium according to an embodiment of the present invention. As may be appreciated, there will be an expense required to provide an identification device (101) with every piece or sheet of a supply of print medium. While such an expense may be justified for a secured print medium, such as letterhead or check sheets, such expense may be prohibitive for a more commonly used print medium, such as letter paper.

Consequently, the present invention includes an embodiment in which a stack or supply (130) of a print medium (100*a*) is provided. However, rather than having an identification device (101) embedded in, or attached to, each sheet or piece of print medium (100*a*), an identification device (101) is embedded in, or attached to, only an end piece or sheet, e.g., a top or bottom piece or sheet.

The printer or printing device will read the single identification device (101) associated with the stack (130) and will then treat each sheet or piece of print medium in the supply or stack (130) as being the same as the lead sheet identified with the identification device (101).

Figure 4:
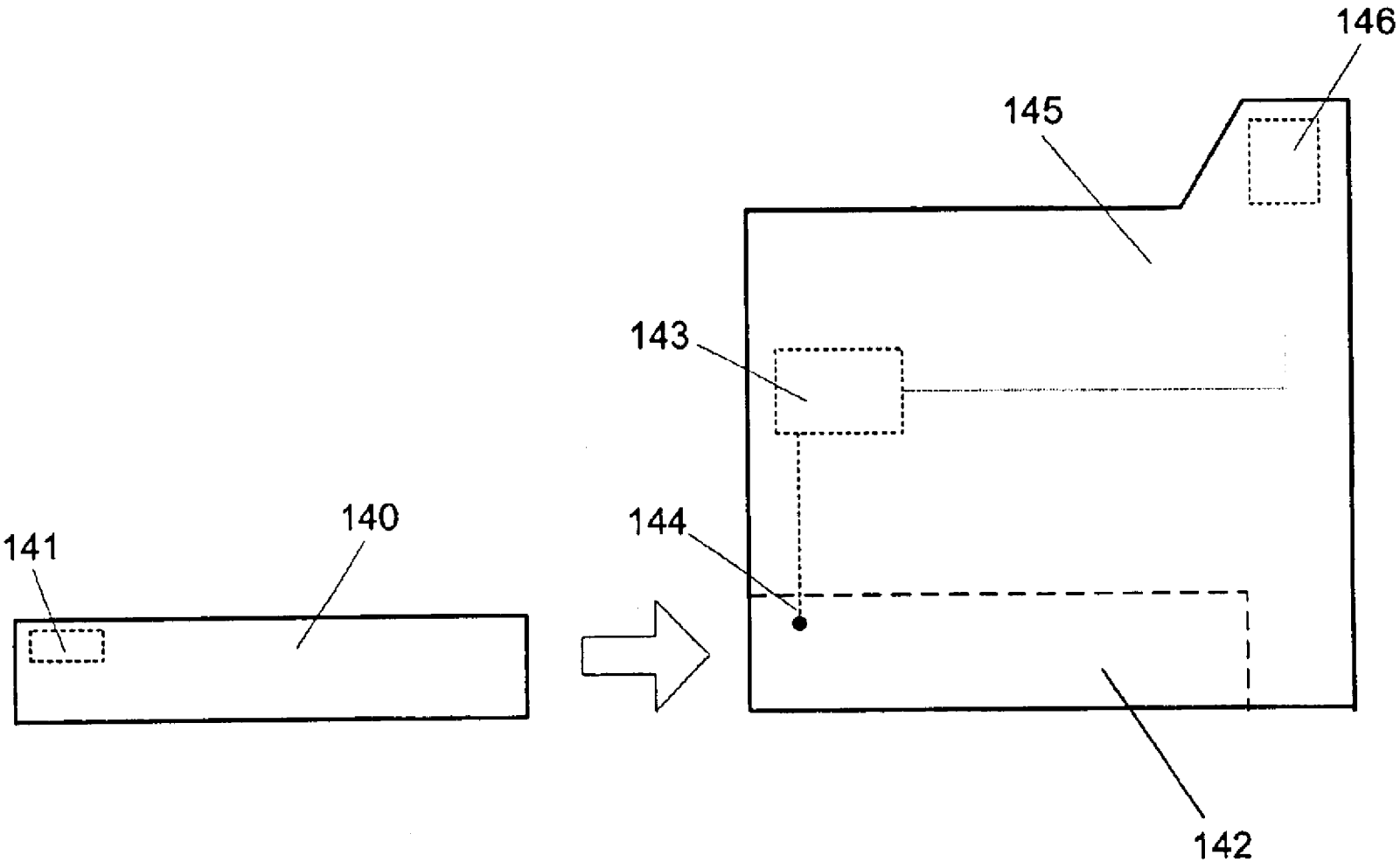
FIG. 4 illustrates a printer according to an embodiment of the present invention.

FIG. 4 illustrates a printer according to an embodiment of the present invention. As shown in FIG. 4, the printer (145) includes a tray (140) in which a supply of print medium can be placed. The tray (140) is received in a bay (142) within the printer (145) housing. When engaged in the bay (142), the print medium in the tray (140) is available to a feeding mechanism (not shown) of the printer that pulls sheets or pieces of print medium as needed by the printer (145).

The tray (140) also includes a reader (141) for reading the identification device (101; FIG. 1) that may be attached to, or embedded in, a sheet or sheets or print medium. The reader (141) may be any of a wide number of devices for reading the variety of possible identification devices (101) that might be employed in various embodiments. For example, the reader (141) may include a radio frequency transceiver for exciting a passive RF transmitter (102; FIG. 2) and receiving a responsive transmission from the passive transmitter. Alternatively, the reader (141) may include a bar code scanner, an optical sensor, a magnetic sensor, etc. The precise apparatus of the reader (141) will be chosen in correspondence with the type of identification device or devices (101; FIG. 1) being used.

When the tray (140) is engaged in the bay (142), the reader (141) will be communicatively coupled (144) with a processor or controller (143) of the printer (145). The processor (143) will receive the information obtained by the reader (141) from the identification device with the print medium. The processor (143) will then control the print parameters of the printer (145) in accordance with that information, or will require a user to input an authorized identifier before printing on a print medium identified as a secured print medium.

Additionally, in some embodiments, the reader (141) may also be capable of writing information to the identification device (101; FIG. 1) on the print medium. In this way, a user may enter information through a user interface (146) of the printer that is conveyed to the reader/writer (141) and then written to the identification device (101; FIG. 1).

For example, a user may wish to record such information as the date/time of printing, document name, author name, printer name/location, etc. in the identification device (101; FIG. 1) of the print medium. Similarly, a manufacturer may wish to write information such as when the print medium was produced, when or to where it was shipped, etc.

A manufacturer may also wish to write to the identification device an indication of the quality of the print medium, for example, that the print medium is a genuine product of a well-known manufacturer. The printer could then read this information from the identification device and display or otherwise notify a user about the quality of the print medium.

Figure 5:
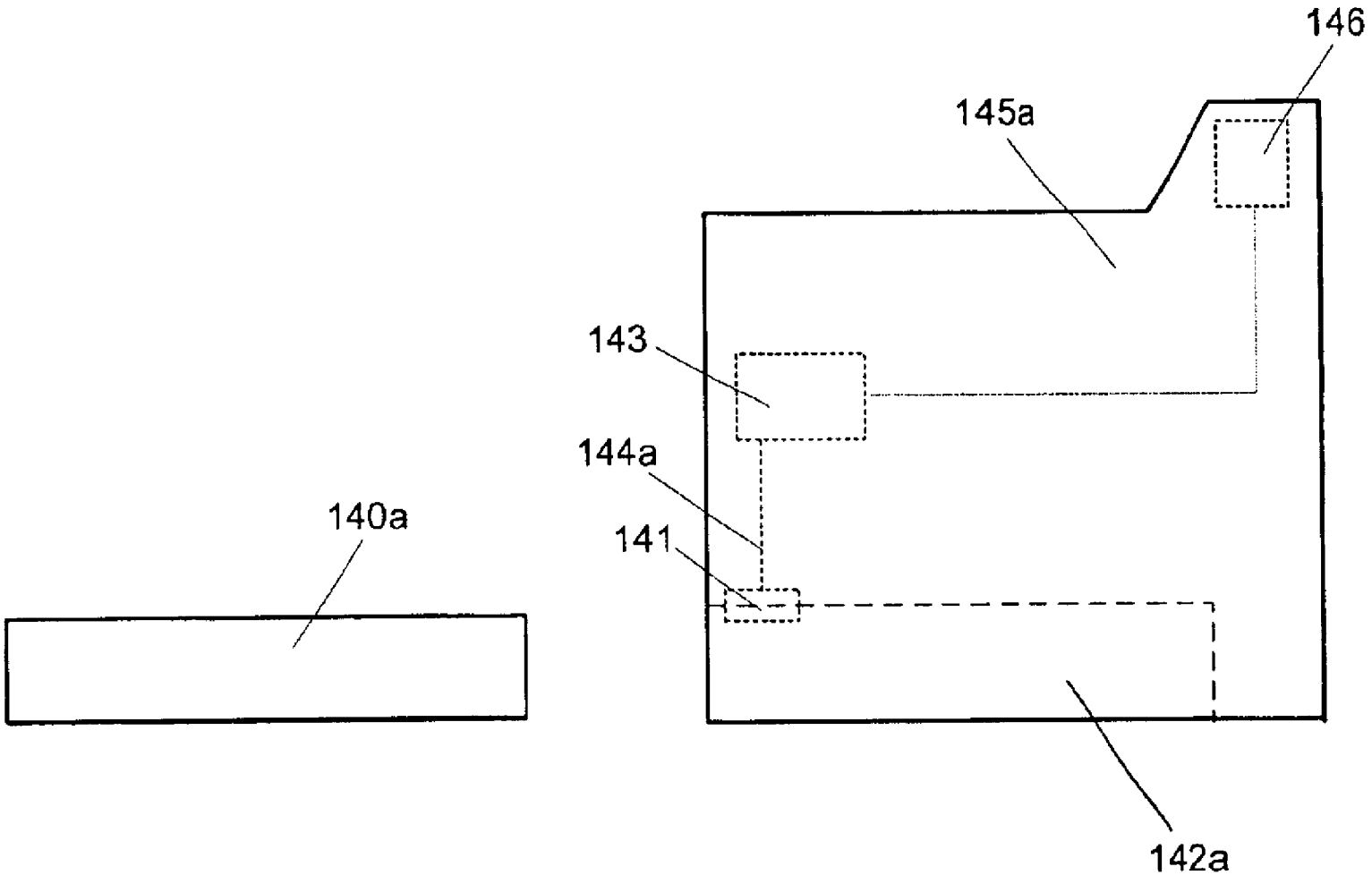
FIG. 5 illustrates a second printer according to another embodiment of the present invention.

FIG. 5 illustrates a second printer according to another embodiment of the present invention. As shown in FIG. 5, the reader or reader/writer (141) can also be positioned in the printer (145*a*) and need not be in a tray (140*a*).

If fact, some printers do not use trays, but rather simply have a bay (e.g., 142*a*) in which the supply of print medium is placed for use by the printer (145*a*). In such a printer, the reader or reader/writer (141) for the identification device (101; FIG. 1) would be placed in the bay (142*a*) in order to communicate with the identification device or devices provided with the print medium.

Figure 6:
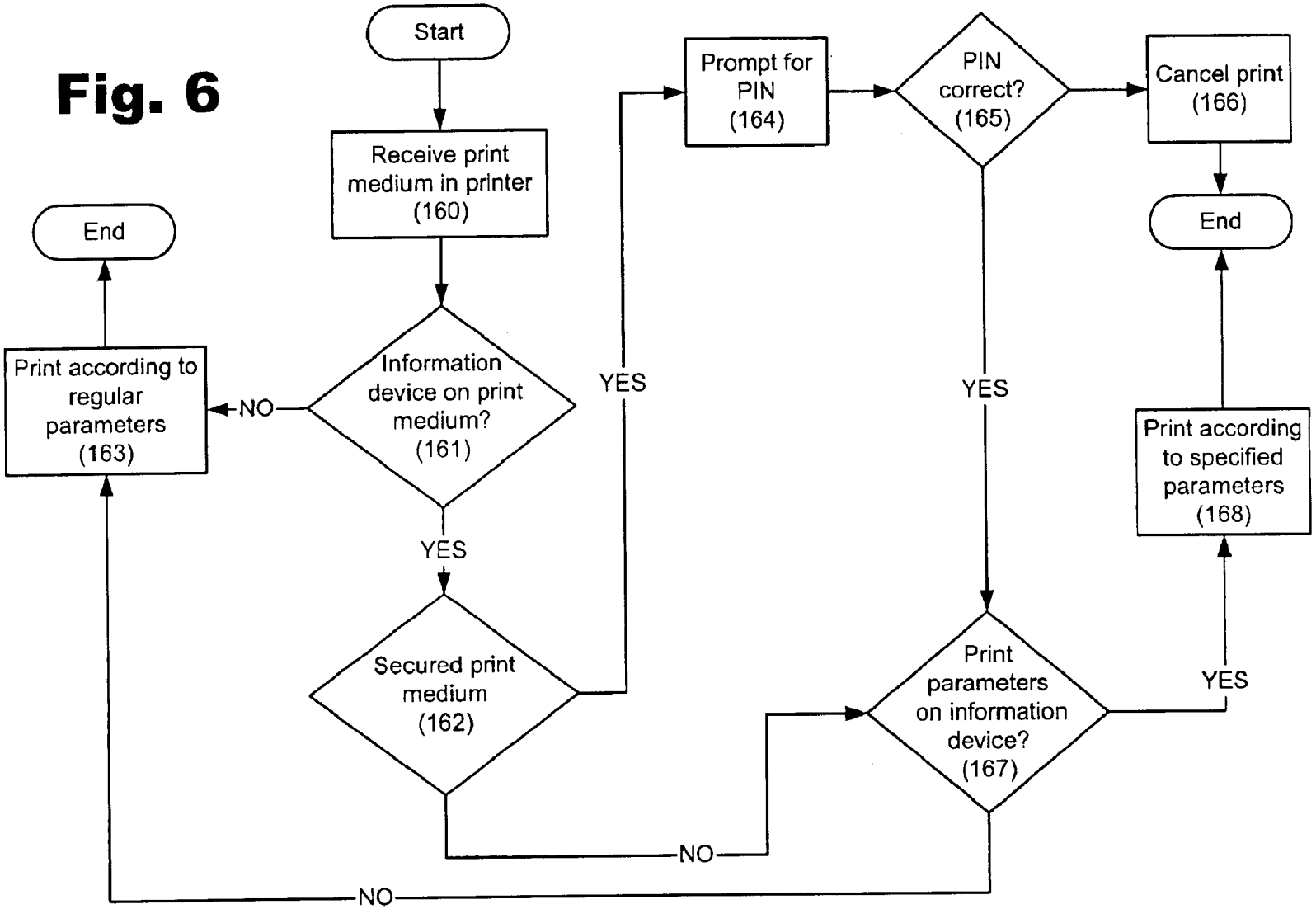
FIG. 6 is a flowchart illustrating a method of using the print media of FIGS. 1 and 2 in a printer, such as those in FIGS. 4 and 5, according to an embodiment of the present invention.

FIG. 6 is a flowchart illustrating a method of using print media with identification devices in a printer. As shown in FIG. 6, the print medium is placed in the printer (step 160). This may be placing the print medium in a tray or in a print medium bay. Next, the printer will attempt to detect and read any identification device (101; FIG. 1) on the print medium (determination 161). If no identification device is detected, any submitted print job will be printed using regular, unadjusted printing parameters (step 163).

If an identification device is detected, the printer will determine if the print medium is a secured print medium (determination 162). If the print medium is secured, the printer will prompt the user to input an identifier, such as a personal identification number (PIN) (step 164). If the input identifier matches that of an authorized user (determination 165), the printer will proceed with the print job. If the input identifier does not match that of an authorized user, the printer will cancel the pending print job (step 166).

Once an authorized identifier has been input, or if the print medium is not secured and does not require input of an authorized identifier, the printer will determine if the identification device (101; FIG. 1) on the print medium specifies any parameters that will optimize printing on that print medium (determination 167). If no such parameters are provided by the identification device, printing is executed according to the regular parameters (step 163).

If, however, the identification device (101; FIG. 1) provides parameters regarding optimal printing conditions for the print medium, those parameters are retrieved from the identification device. Printing then proceeds in accordance with the specified parameters retrieved from the identification device and appropriate for that print medium (step 168).

Figure 7:
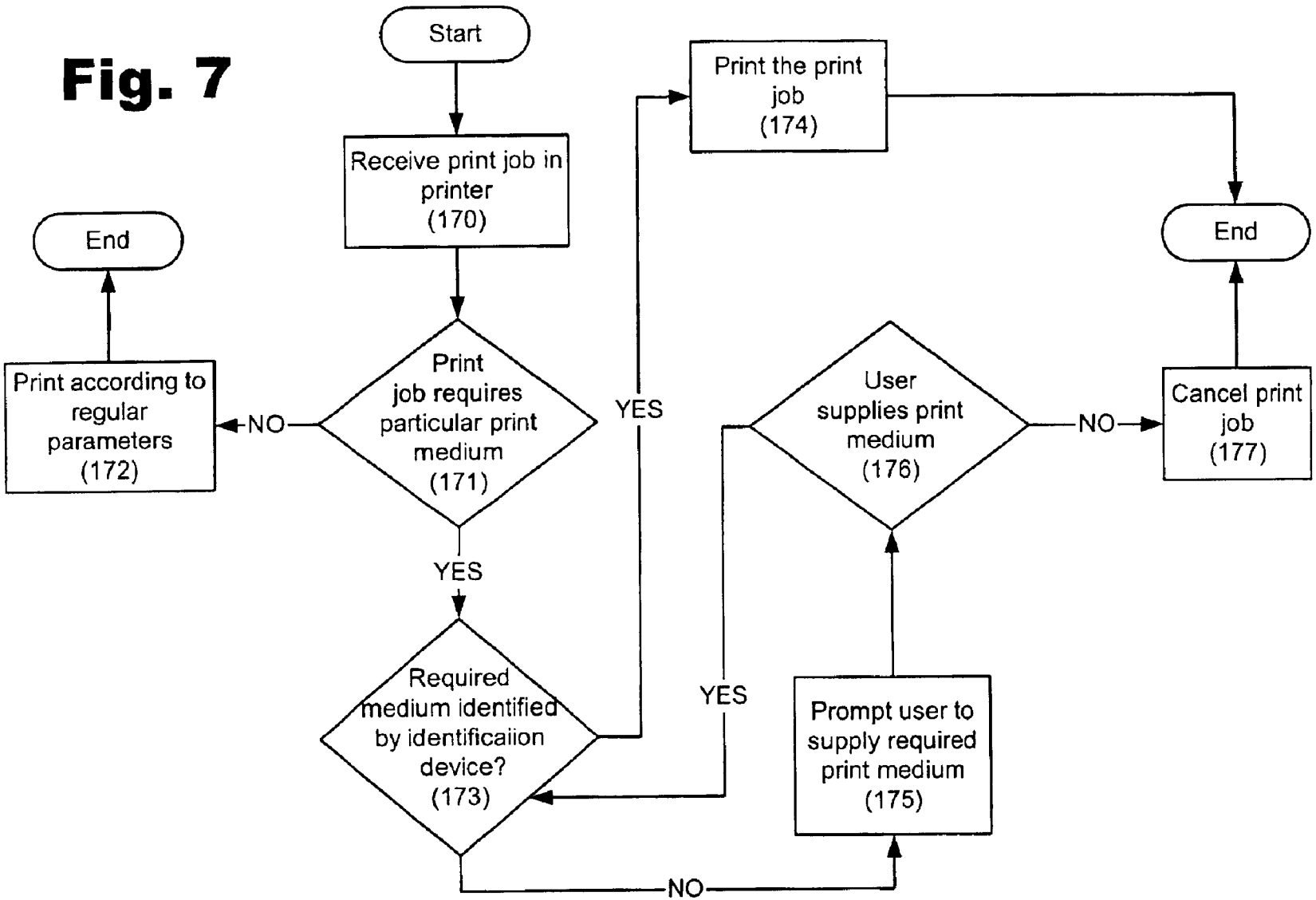
FIG. 7 is a flowchart illustration another method of using the print medium of FIGS. 1 and 2 in a printer, such as those in FIGS. 4 and 5, according to another embodiment of the present invention.

FIG. 7 illustrates another possible method for using an identification device in or on a print medium. For example, it may be desired that certain print jobs are only printed on a particular type of print medium. An identification device can be used to ensure that the print job is only printed if the appropriate print medium is supplied.

As shown in FIG. 7, the printer receives a print job (step 170). The print job may instruct the printer that the print job is only to be printed on a particular type of print medium (determination 171). If no such requirement exists, the print job can proceed according to regular parameters (step 172).

However, if the print job does specify that a particular print medium be used, the printer can read the identification device associated with the available print medium or media to determine if the specified medium is available (determination 173). If the specified print medium is available, it is used and the print job is printed (step 174). If the specified print medium is not available, the user may be prompted to supply the specified print medium (step 175). If the user does so (determination 176), the print medium is preferably checked again (determination 173) and, if it is the specified print medium, the print job is printed (step 174). If the user does not supply the specified print medium (determination 176), the print job is cancelled (step 177).

In some embodiments, identifying the correct print medium may be done by matching an encryption pair. One part of the encryption pair is encoded in the identification device on the print medium, and the other part is supplied by the printer or user.

The preceding description has been presented only to illustrate and describe embodiments of invention. It is not intended to be exhaustive or to limit the invention to any precise form disclosed. Many modifications and variations are possible in light of the above teaching. It is intended that the scope of the invention be defined by the following claims.

What is claimed is:

1. A print medium comprising an identification device with said print medium, wherein said identification device comprises encoded printing parameters for optimizing or controlling printing by a printer on said print medium;

wherein said identification device specifies a requirement that a user be authenticated before said print medium is used.

2. The print medium of claim 1, wherein said print medium comprises letterhead.

3. The print medium of claim 1, wherein said print medium comprises commercial paper.

4. The print medium of claim 1, wherein said identification device comprises an integrated circuit.

5. The print medium of claim 4, wherein said integrated circuit comprises:

read only memory; and a passive radio frequency transmitter.

6. The print medium of claim 1, wherein said identification device comprises a bar code.

7. The print medium of claim 1, wherein said identification device comprises micro dots.

8. The print medium of claim 1, wherein said identification device comprises a magnetic charge.

9. The print medium of claim 1, wherein said identification device comprises cuts in an edge of said print medium.

10. The print medium of claim 1, wherein said identification device comprises a sticker.

11. The print medium of claim 1, wherein said print medium comprises a supply of a print medium, and said identification device is associated with an end piece of said print medium in said supply.

12. The print medium of claim 11, wherein other pieces of print medium in said supply do not include an identification device.

13. A print medium comprising an identification device with said print medium, wherein said identification device comprises encoded printing parameters for optimizing or controlling printing by a printer on said print medium, wherein said identification device comprises a texture pattern on said print medium.

14. A print medium comprising an identification device with said print medium, wherein said identification device comprises encoded printing parameters for optimizing or controlling printing by a printer on said print medium, wherein said identification device comprises a ripple pattern in said print medium.

15. A method of improving print quality in a printer, comprising:

reading one or more printing parameters with a reader in the printer from an identification device associated with a print medium; and controlling actual printing parameters in accordance with said printing parameters read from said identification device;

wherein said printing parameters of said identification device comprise a requirement for input of an authorized identifier, said method comprising canceling a pending print job unless said authorized identifier is input to said printer.

16. A system for improving print quality in a printer, comprising:

means for reading one or more printing parameters from an identification device associated with a print medium; and means for controlling actual printing parameters in accordance with said printing parameters read from said identification device;

wherein said printing parameters of said identification device comprise a requirement for input of an authorized identifier, said system further comprising:

means for receiving an identifier from a user; and means for canceling a pending print job unless said identifier matches an authorized identifier.

17. The system of claim 16, further comprising:

means for receiving user input specifying one or more printing parameters; and means for writing said user input to said identification device.

18. The system of claim 16, further comprising a tray for containing a supply of the print medium, said means for reading being disposed in said tray.

19. A method of securing use of a print medium, comprising:

reading an indication of a secured print medium, with a reader in a printer, from an identification device associated with a secured print medium; and requiring a user to input an authorized identifier before using the secured print medium to print a print job.

20. The method of claim 19, further comprising:

receiving user input of an identifier;

comparing said identifier to a list of authorized identifiers;

if said identifier matches an authorized identifier, printing said print job; and if said identifier does not match an authorized identifier, canceling said print job.

* * * * *